US009624694B2

(12) United States Patent
Kincaid

(10) Patent No.: US 9,624,694 B2
(45) Date of Patent: Apr. 18, 2017

(54) TAMPER DETECTION MECHANISM FOR ELECTRONIC LOCK DEVICE

(71) Applicant: Schlage Lock Company LLC, Indianapolis, IN (US)

(72) Inventor: Ryan C. Kincaid, Indianapolis, IN (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/269,008

(22) Filed: May 2, 2014

(65) Prior Publication Data

US 2015/0315815 A1 Nov. 5, 2015

(51) Int. Cl.
*E05B 39/00* (2006.01)
*E05B 45/06* (2006.01)

(52) U.S. Cl.
CPC ..... *E05B 45/06* (2013.01); *E05B 39/00* (2013.01)

(58) Field of Classification Search
CPC ..... E05B 45/00; E05B 45/06; E05B 39/00; E05B 63/0017; G06F 3/044; H03K 17/955
USPC ..... 340/542, 545.1, 545.4, 545.6, 562; 700/17, 83, 231, 242
See application file for complete search history.

(56) References Cited

U.S. PATENT DOCUMENTS

| | | | | |
|---|---|---|---|---|
| 4,804,945 | A | 2/1989 | Millet | |
| 7,355,515 | B2 | 4/2008 | Lee et al. | |
| 7,602,286 | B2 | 10/2009 | DiPoala | |
| 7,616,116 | B2 | 11/2009 | Ehrensvard et al. | |
| 8,011,217 | B2 | 9/2011 | Marschalek et al. | |
| 8,339,261 | B1 * | 12/2012 | Wolski | 340/545.6 |
| 2007/0222554 | A1 * | 9/2007 | Hart | 340/5.6 |
| 2009/0102652 | A1 | 4/2009 | Diener et al. | |
| 2010/0315233 | A1 | 12/2010 | Eichenstein et al. | |
| 2014/0152420 | A1 * | 6/2014 | Wolski | 340/5.6 |

* cited by examiner

*Primary Examiner* — Hung T Nguyen
(74) *Attorney, Agent, or Firm* — Taft Stettinius & Hollister LLP

(57) ABSTRACT

An apparatus and method for tamper detection of an electronic lock device using a capacitive proximity sensor. The capacitive proximity sensor is positioned on a printed circuit board that is positioned in an inner region of a housing of the electronic lock device. An electronic signal is transmitted to a conductive element, such as, for example, an area of a copper layer(s) or trace(s) on the printed circuit board. The transmitted electronic signal is monitored to determine a capacitance value. The capacitance value is evaluated to determine whether the capacitance value corresponds to known or predetermined capacitance values that are associated with a cover plate covering an opening of the inner region. In the event the capacitance value is determined to be outside of predetermined capacitance values, and signal may be generated to a reporting authority indicating the removal of the cover plate from the housing.

20 Claims, 3 Drawing Sheets

TAMPER DETECTION MECHANISM FOR ELECTRONIC LOCK DEVICE

BACKGROUND

Embodiments of the present invention generally relate to tamper detection in electronic locks. More particularly, embodiments of the present invention relate to a capacitive proximity sensor for detecting the removal of a cover plate of an electronic lock.

The operation of certain types of mechanical switches used for tamper detection for electronic locks often rely on the displacement of a component of the mechanical switch through physical engagement with an adjacent mechanism or component of the lock device. For example, certain types of lock devices may utilize a protrusion, such as, for example, a rubber stopper, that extends from a rear side of a cover plate that engages a pivotally displaceable lever arm of a mechanical switch that is mounted to a printed circuit board. Such engagement by the protrusion may displace, and hold, the lever arm to/at a particular position, such as, for example, a first position that places the mechanical switch in an open or closed positioned. When the cover plate is moved away from the mechanical switch, the protrusion may no longer engage the lever arm, thereby allowing the lever arm to be displaced to another position, such as, for example, a second position that changes the open/closed position of the mechanical switch.

As such mechanical switches rely on physical engagement and displacement of one or more components of the mechanical switch, the switches are susceptible to mechanical failure, fatigue, and/or damage. For example, improper installation of the cover plate may result in the cover plate and/or protrusion at least initially engaging the level arm of the mechanical switch in a direction and/or manner that damages the lever arm. Further, over time, the protrusion, or the connection of the protrusion to the cover plate, may deteriorate so that the protrusion ceases to effectively engage and displace the lever arm. Additionally, unauthorized removal of the cover plate may be undetected in circumstances in which the cover plate is removed in a manner that allows for the position of the lever arm of the mechanical switch to remain relatively undisturbed. Further, the inclusion of a mechanical switch and the protrusion may increase the complexity of at least assembly and component cost of the electronic lock device.

BRIEF SUMMARY

An aspect of the present invention is a unique apparatus and method for tamper detection in an electronic lock using a capacitive proximity sensor. Other embodiments include apparatuses, systems, devices, hardware, methods, and combinations for tamper detection in an electronic lock using a capacitive proximity sensor. Further embodiments, forms, features, aspects, benefits, and advantages of the present application shall become apparent from the description and figures provided herewith.

An aspect of the present invention is a method for detecting tampering of an electronic lock device. The method includes establishing one or more capacitance values that correspond to a cover plate being positioned to operably cover an opening to an inner region of a housing of the electronic lock device. The method further includes transmitting an electric signal to a conductive element contained within the housing, and determining a monitored capacitance value using the transmitted electric signal. Additionally, the monitored capacitance value is evaluated with respect to the established one or more capacitance values to determine whether the cover plate remains positioned to operably cover the inner region.

Another aspect of the present invention is a method for detecting tampering of an electronic lock device that includes transmitting an electric signal from a capacitance proximity sensor to a conductive element that is contained within an inner region of a housing of the electronic lock. Additionally, the capacitance proximity sensor monitors the transmitted electric signal, and determines a capacitance value based at least in part from information obtained from monitoring the electric signal. Further, the capacitance value is transmitted to an evaluator module and evaluated using an algorithm of the evaluator module. The method also include determining whether the evaluated capacitance value corresponds to one or more established capacitance values that are associated with the cover plate being operably positioned about an opening of the inner region.

Additionally, a further aspect of the present invention is a tamper detection mechanism for an electronic lock comprising a housing assembly having a cover plate, a printed circuit board, and a housing. The cover plate is configured for removable attachment to the housing. Additionally, the housing has one or more sidewalls that generally define an inner region, the inner region being configured to receive insertion of the printed circuit board. Further, a capacitance proximity sensor and a conductive element are operably connected to each other on the printed circuit board. The capacitance proximity sensor is adapted to monitor an electric signal that is transmitted to the conductive element to obtain a capacitance value. The tamper detection mechanism also includes an evaluator module that is operably connected to the capacitance proximity sensor. The evaluator module is adapted to determine whether the capacitance value is outside a predetermined range of capacitance values that correspond to the cover plate being positioned to operably cover an opening to the inner region.

Other aspects of the present invention will become apparent by consideration of the detailed description and accompanying drawings.

Figure 1:
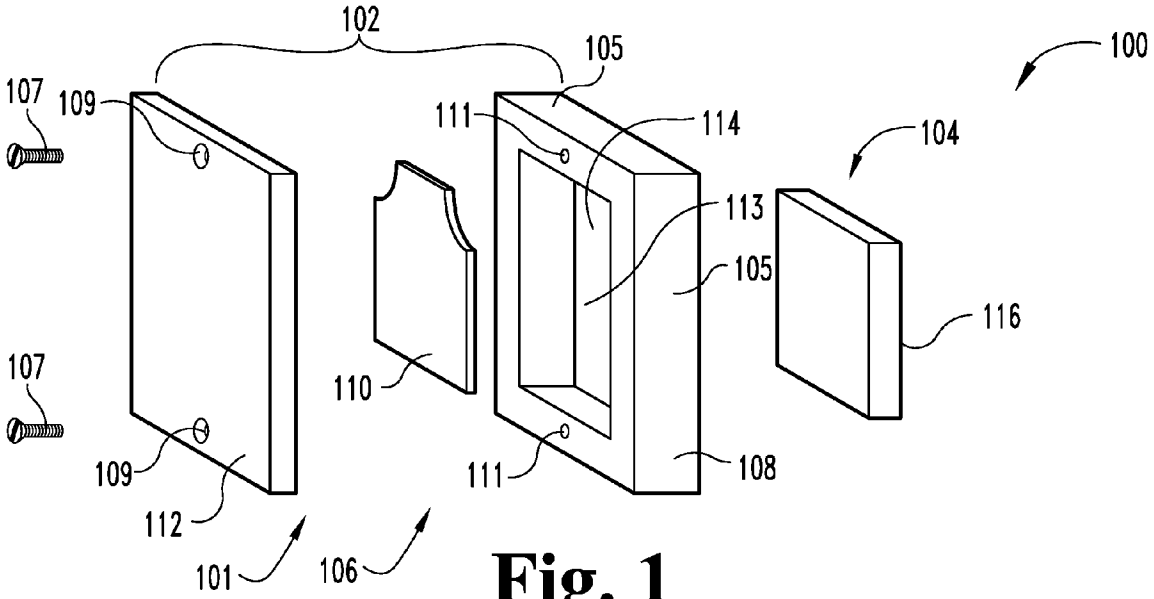
FIG. 1 illustrates an exploded side view of a portion of an exemplary electronic lock device having a tamper detection mechanism according to an illustrated embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

FIG. 1 illustrates an exploded side view of a portion of an exemplary electronic lock device 100 according to an illustrated embodiment of the present invention. The electronic lock device 100 may be used to control the ingress and/or egress through an entryway. According to certain embodiments, the electronic lock device 100 includes a first portion 102 and a second portion 104 that are located at opposing sides of the entryway. For example, the first portion 102 may be generally positioned about an interior side of entryway, while the second portion 104 may be generally located about an exterior side of the entryway. The first portion 102 of the electronic lock device 100 may include a tamper detection mechanism 101 that has a housing assembly 106 that includes a housing 108, a printed circuit board ("PCB") 110, and a cover plate 112. The housing 108 may include one or more sidewalls 105 that generally define an inner region 114 of the housing 108, the inner region 114 having an opening 113 that allows for the passage of a printed circuit board 110 into the inner region 114. Further, the cover plate 112, or escutcheon cover, may be secured to the housing 108 to enclose or otherwise cover at least a portion of the opening 113. The cover plate 112 may be secured to the housing 108 in a number of different manners, including, for example, through the use of one or more mechanical fasteners 107, such as, for example, a screw, bolt, pin, clip, and/or snap fit, among other connections. For example, according to the illustrated embodiment, at least a portion of mechanical fasteners 107 pass through an associated opening 109 in the cover plate 112 and threadingly engage openings 111 of the housing 108 so as to secure the cover plate 112 to the housing 108.

Figure 2:
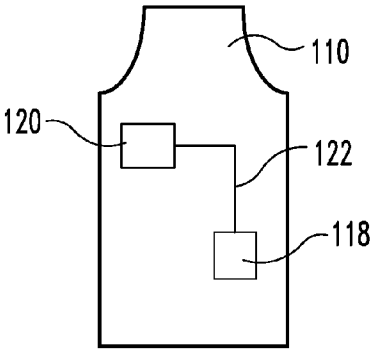
FIG. 2 illustrates a front side view of a printed circuit board having a conductive element for use in detecting potential tampering of an electronic lock device according to an illustrated embodiment of the present invention.

As shown in FIG. 2, the printed circuit board 110 may include a microcontroller 118 that is operably connected, such as via a wired or wireless connection, to an actuator (not shown), such as, for example, a motor or a solenoid. According to the illustrated embodiment, the actuator may be configured to control the displacement of an latch mechanism, such as, for example, a dead bolt. Moreover, the actuator is configured to displace at least a portion of the latch mechanism from a locked position, wherein the lock mechanism is positioned to prevent the displacement of an access control device, such as, for example, a door or gate, relative to the associated entryway, and an unlocked position, wherein the access control device may displaced so as to allow ingress/egress through the entryway.

Referencing FIG. 1, the second portion 104 of the electronic lock device 100 may include a user interface 116 that is used in connection with controlling the operation of the electronic lock device 100. According to certain embodiments, the user interface 116 may be a keypad or reader, among other user interfaces 116. Further, for example, the user interface 116 may be configured to detect, read, and/or receive a signal or other information inputted by the user or provided by a separate device, such as, for example, information provided by a smart or memory card or mobile electronic device, among other devices. Additionally, according to certain embodiments, the user interface 116 may be a radio frequency identification (RFID) reader. The user interface 116 is operably connected to the printed circuit board 110, and more particularly, to the microcontroller 118, such as, for example, via a wired or wireless connection. For example, in the illustrated embodiment, one or more wires operably connect the user interface 116 to the printed circuit board 110 so that, for example, information or signals indicative of information provided through use of the user interface 116 may be at least communicated to the printed circuit board 110, and thereby provided to the microcontroller 118.

Figure 3:
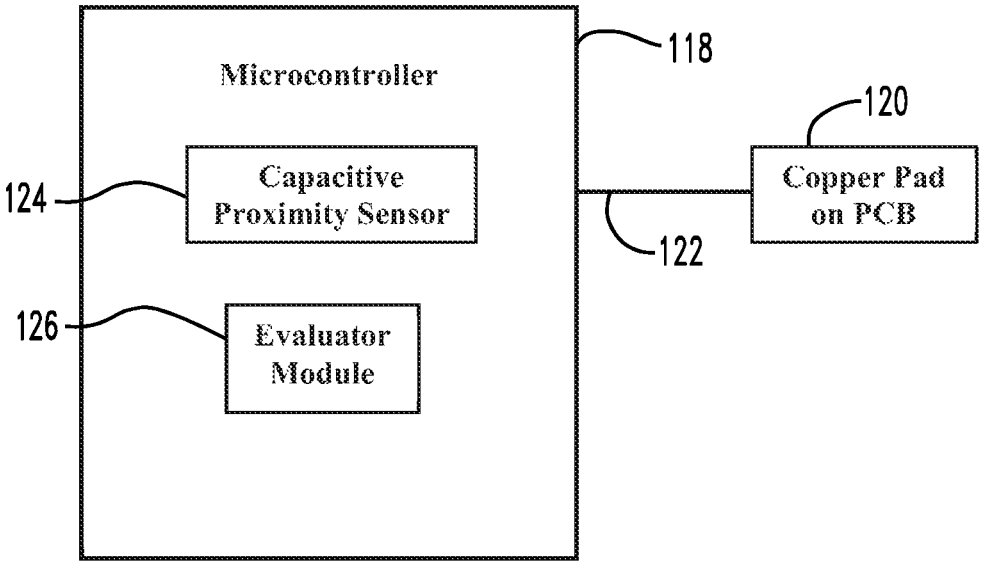
FIGS. 3 and 4 illustrate schematic block diagrams of capacitive proximity circuits for detecting potential tampering of an electronic lock device according to illustrated embodiments of the present invention.
Figure 4:
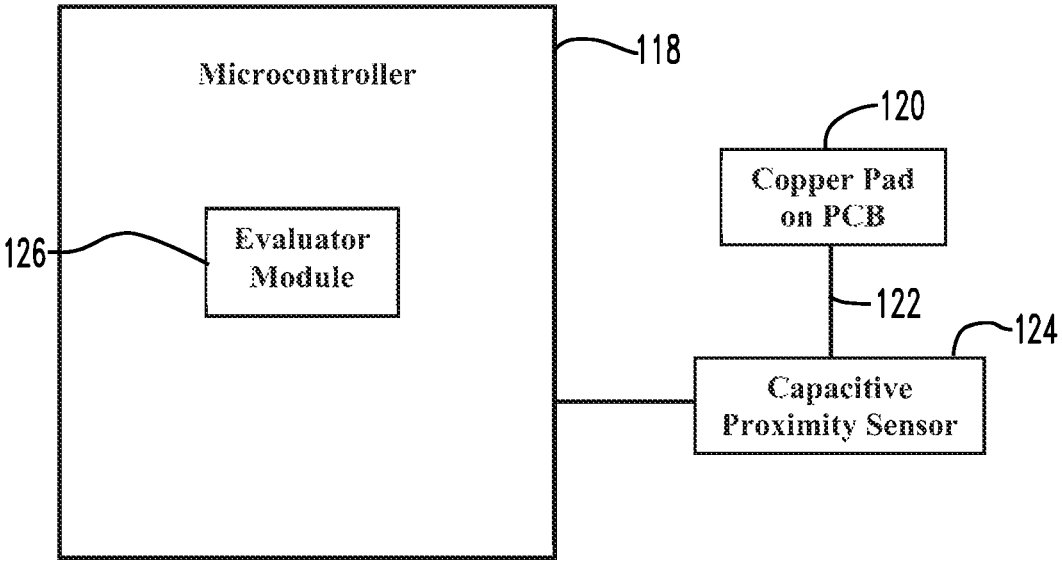

Referencing FIGS. 2-4, the microcontroller 118 is operably connected to a conductive element 120, such as, for example, via one or more traces 122. The conductive element 120 may take a variety of different forms, such as, for example, an area of one or more conductive layers of the printed circuit board 110, such as, for example, a conductive pad comprising an area or pad of copper of the printed circuit board 110, a conductive wire, one or more trace elements of the printed circuit board 110, or other conductive components of, or within, the housing 108, such as, for example, a metal portion of the housing 108. Additionally, according to certain embodiments, as shown in FIG. 3, the microcontroller 118 includes a capacitive proximity sensor 124 and a evaluator module 126 that are implemented in software and/or hardware. Further, as shown in FIG. 4, according to certain embodiments, the capacitive proximity sensor 124 may be a separate capacitance sensor that is operably connected to the microcontroller 118, such as, for example, via one or more traces 122.

The capacitance proximity sensor 124 may be configured to sense a capacitance value of the conductive element 120. Moreover, an environmental change, such as the change or removal of a component of the electronic lock device 100 that is relatively adjacent, or in relative close proximity, to the conductive element 120 may result in an alteration of a capacitance value of the conductive element 120. Thus, the capacitance of the conductive element 120 may be used to provide an indication of the proximity of the cover plate 112 to the conductive element 120 without requiring direct physical contact between the capacitance proximity sensor 124 and the cover plate 112. According to certain embodiments, the capacitance proximity sensor 124 is a high resolution timer that monitors a charge time measurement, such as, for example, the rate of decay of a transmitted electronic signal in the conductive element 120. The monitored rate of decay may be used to determine the capacitance value. However, besides charge time measurements, the capacitance of the conductive element 120 may be determined in a variety of other, different manners, including, for example, frequency modulation, shift of resonance frequency, duty cycle amplitude modulation, and time delay measurement, among other capacitance measurements.

The determined capacitance value may be delivered from the capacitance proximity sensor 124 to the evaluator module 126. The evaluator module 126 is configured to evaluated the capacitance value in relation to established or expected capacitance values associated with a particular condition of the electronic lock device 100, such as, for example, through the use of an algorithm. For example, the capacitance value when the cover plate 112 is covering the opening to the inner region 114 of the housing 108 is typically different than when the cover plate 112 is removed from the housing 108. Thus, comparing the capacitance value delivered from the proximity sensor 124 with established capacitance values that are associated with the cover plate 112 being in a particular location relative to the opening 113 of the inner region 114 may provide an indication of whether the cover plate 112 is, or is not, still generally in that location. According to certain embodiments, capacitance values are evaluated in reference to one or more established capacitance values that correspond to the cover 112 covering the opening 113 to the inner region 114 or otherwise being operably secured to the housing 108, such as, for example, via the mechanical fasteners. Additionally, according to certain embodiments, the established capacitance value may be provided by a calibrated capacitance value, as discussed below. Thus, by using the built in features of the microcontroller 118 in conjunction with proprietary firmware algorithms and the conductive element 120, tamper detection of the electronic lock device 110 can be achieved be determining whether a component of the electronic lock device 100, such as, for example, a cover plate 112, has been removed or otherwise displaced from a particular location of the electronic lock device 100.

Figure 5:
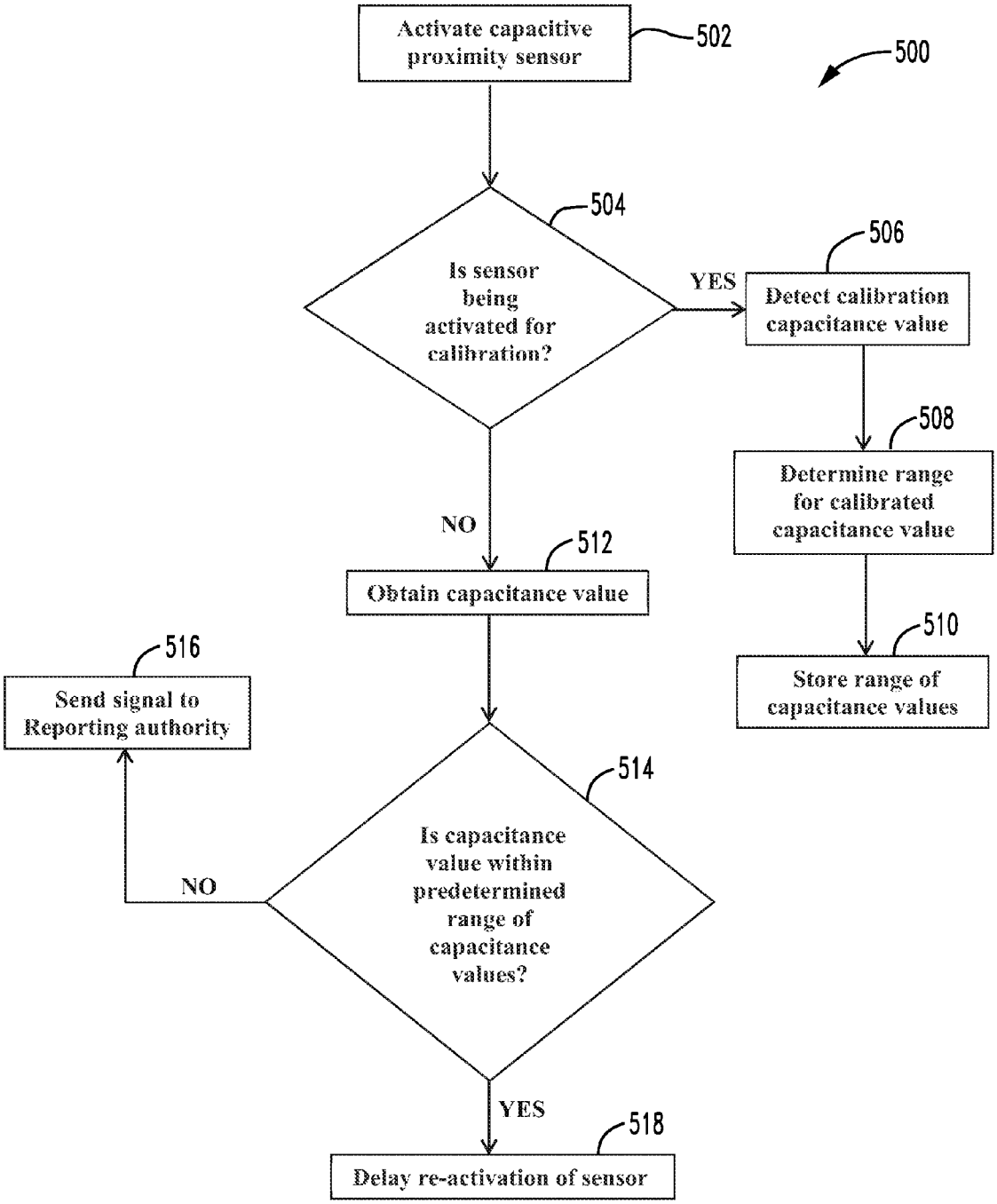
FIG. 5 illustrates a flow chart of a method for detecting potential tampering of an electronic lock device according to an illustrated embodiment of the present invention.

FIG. 5 illustrates a flow chart of a method 500 for detecting potential tampering of an electronic lock device 100 according to an illustrated embodiment of the present invention. At step 502, the microcontroller 118 may provide a signal indicating that at least the capacitance proximity sensor 124 is to be activated, such as, for example, a signal initiating the transmission of an electric signal to the conductive element 120. The capacitance proximity sensor 124 may be activated for a variety of different reasons. For example, according to certain embodiments, the capacitance proximity sensor 124 may be activated for purposes of obtaining a calibrated capacitance value, such as, for example, during manufacturing, installation, and/or maintenance of the electronic lock device 100 that is associated with the cover plate 112 covering the opening 113 to the inner region 114 of the housing 108 and/or the cover plate 112 being secured to the housing 108. The procedure to obtain a calibrated capacitance value may be initiated in a variety of different manners, such as, for example, by a user entering a particular code into the user interface 116, and/or a particular signal being received or otherwise detected via the user interface 116. If the capacitance proximity sensor 124 is being activated for purposes of obtaining a calibrated capacitance signal, then at step 506 the capacitance proximity sensor detects a calibrated capacitance value, such as, for example, by measuring the rate of decay of the transmitted electric signal in the conductive element 120. At step 508, according to certain embodiments, a predetermined range of capacitance values may be determined based on at least one calibrated capacitance value. Further, according to certain embodiments, the predetermined range of capacitance values may be based on a variety of factors, including, for example, a predetermined percentage of anticipated variation in the calibrated capacitance value. Alternatively, the predetermined range of capacitance values may be obtained by the repeated transmission and monitoring of calibration electric signals sent to the conductive element 120. At step 510, the predetermined range of capacitance values may be stored, such as, for example, in the memory of the microcontroller 118 or in an memory that is external to the microcontroller 118.

If, however, the capacitance proximity sensor 124 is not being activated for purposes related to calibration, then at step 512 the sensor 124 obtains a capacitance value relating to the electric signal provided at step 502. At step 514, the received capacitance value is evaluated to determine whether the capacitance value satisfies an established capacitance value, such as, for example, being within a predetermined range of capacitance values that correspond to the cover plate 112 covering an opening 113 of the housing 108 and/or the cover plate 112 being secured to the housing 108. For example, as previously discussed, according to certain embodiments, the capacitance value is provided to the evaluator module 126 and evaluated using an algorithm to determine whether the evaluated capacitance value is, or is not, within a predetermined range of capacitance values.

At step 516, if the evaluated capacitance value is outside the predetermined range of capacitance values, a signal may be generated from the microcontroller 110 and/or evaluator module 126 to a reporting authority, such as, for example, to a server, central management service, mobile telephone, or other device indicating that the cover plate 112 has been removed from the housing 108. According to certain embodiments, the microcontroller 118 may be operably connected to an antenna or transceiver that allows for the transmission of the signal to the reporting authority. The signal may then be evaluated to determine whether the removal of the cover plate 112 was authorized, such as, for example, in connection with authorized service of the electronic lock device 100, or may have been the product of unauthorized tampering with the electronic lock device 100.

However, if the evaluated capacitance value is within the predetermined range of capacitance values, then at step 518, a timer can be initiated that delays the re-activation of the capacitance proximity sensor 124, and moreover sets the time for initiating the transmission of the next monitored electric signal to the conductive element 120. According to certain embodiments, the timer may be part of the evaluator module 126.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A method for detecting tampering of an electronic lock device, the method comprising:

establishing one or more capacitance values that correspond to a cover plate being positioned to operably cover an opening to an inner region of a housing of the electronic lock device;

transmitting an electric signal to a conductive element contained within the housing;

determining a monitored capacitance value using the transmitted electric signal; and evaluating the monitored capacitance value with respect to the established one or more capacitance values to determine whether the cover plate remains positioned to operably cover the inner region.

2. The method of claim 1, wherein the step of determining the monitored capacitance value includes obtaining a charge time measurement of the transmitted electric signal.

3. The method of claim 2, wherein the step of evaluating the monitored capacitance value includes applying an algorithm using the monitored capacitance value to determine whether the monitored capacitance value is within a predetermined range of the established one or more capacitance values.

4. The method of claim 3, wherein the step of establishing one or more capacitance values includes:

positioning the cover plate about the opening to operably cover to the inner region;

transmitting, when the cover plate is positioned about the opening, one or more calibration electric signals to the conductive element;

monitoring the one or more calibration electric signals;

determining one or more calibrated capacitance values using the monitored one or more calibration electric signals; and recording the one or more calibrated capacitance values, the recorded one or more calibrated capacitance values providing the established one or more capacitance values.

5. The method of claim 4, wherein the predetermined range of capacitance values are at least in part based on an anticipated variation in the determined one or more calibrated capacitance values.

6. The method of claim 4, further including the step of engaging a user interface of the electronic lock device to initiate the transmission of the one or more calibration electric signals.

7. The method of claim 2, further including the step of transmitting, if the monitored capacitance value indicates the cover plate does not remain positioned to operably cover the inner region, a signal indicative of the removal of the cover plate from the housing.

8. The method of claim 7, further including the step of initiating, if the monitored capacitance value indicates the cover plate remains positioned to operably cover the inner region, a timer to set the timing of a subsequent transmission of an electric signal to the conductive element.

9. A method for detecting tampering of an electronic lock device, the method comprising:

transmitting an electric signal from a capacitance proximity sensor to a conductive element contained within an inner region of a housing of the electronic lock device;

monitoring by the capacitance proximity sensor the transmitted electric signal to the conductive element;

determining a capacitance value based at least in part from information obtained from monitoring the transmitted electric signal;

transmitting the capacitance value to an evaluator module;

evaluating the transmitted capacitance value using an algorithm of the evaluator module; and determining whether the evaluated capacitance value corresponds to one or more established capacitance values that are associated with a cover plate being operably positioned about an opening of the inner region.

10. The method of claim 9, wherein the step of determining the capacitance value includes obtaining a decay rate of the transmitted electric signal.

11. The method of claim 10, further including the steps of:

securing the cover plate to the housing;

transmitting, when the cover plate is secured to the housing, one or more electric calibration signals;

monitoring the transmitted one or more electric calibration signals; and determining one or more calibrated capacitance values using information obtained from monitoring the transmitted one or more electric calibration signals; and wherein the one or more calibrated capacitance values provide the one or more established capacitance values.

12. The method of claim 11, further including the steps of:

transmitting to a reporting authority a signal indicative of the cover plate being removed from the housing when the evaluated capacitance value does not correspond to the one or more established capacitance values; and initiating, if the evaluated capacitance value corresponds to the one or more established capacitance values, a timer for timing a subsequent transmission of an electric signal to the conductive element.

13. The method of claim 12, wherein the one or more established capacitance values is a range of the one or more calibrated capacitance values.

14. The method of claim 12, wherein the one or more established capacitance values is a range of capacitance values that is at least in part based on expected variation in the one or more calibrated capacitance values.

15. A tamper detection mechanism for an electronic lock comprising:

a housing assembly having a cover plate, a printed circuit board, and a housing, the cover plate configured for removable attachment to the housing, the housing having one or more sidewalls that generally define an inner region, the inner region configured to receive insertion of the printed circuit board;

a capacitance proximity sensor operably connected to the printed circuit board;

a conductive element positioned on the printed circuit board and operably connected to the capacitance proximity sensor, the capacitance proximity sensor adapted to monitor an electric signal that is transmitted to the conductive element to obtain a capacitance value; and an evaluator module operably connected to the capacitance proximity sensor, the evaluator module being adapted to determine whether the capacitance value is outside a predetermined range of capacitance values that correspond to the cover plate being positioned to operably cover an opening to the inner region.

16. The tamper detection mechanism of claim 15, further including a microcontroller positioned on the printed circuit board, the microcontroller including the evaluator module.

17. The tamper detection mechanism of claim 16, wherein the microcontroller further includes the capacitance proximity sensor.

18. The tamper detection mechanism of claim 15, wherein the conductive element is a copper pad area of the printed circuit board.

19. The tamper detection mechanism of claim 15, wherein the conductive element is a trace of the printed circuit board.

20. The tamper detection mechanism of claim 15, wherein the capacitance proximity sensor is a high resolution timer that is configured to monitor a decay rate of the electric signal that is transmitted to the conductive element.

* * * * *